United States Patent [19]

Theurer et al.

[11] 4,275,659

[45] Jun. 30, 1981

[54] APPARATUS FOR OPERATING TRANSPORT VEHICLES MOVABLE ON A TRACK CARRIED BY A TRAIN OF RAILROAD CARS

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 37,099

[22] Filed: May 8, 1979

[30] Foreign Application Priority Data

Sep. 14, 1978 [AT] Austria ..... 6667/78

[51] Int. Cl.[3] ..... E01B 27/11; E01B 29/05

[52] U.S. Cl. ..... 104/2; 104/1 R; 414/339; 414/342

[58] Field of Search ..... 104/1-6, 104/137, 295, 299; 246/187 C, 182 B; 414/339-342, 345, 347, 348

[56] References Cited

U.S. PATENT DOCUMENTS

| | | | |
|---|---|---|---|
| 1,863,630 | 6/1932 | Keenan et al. | 104/299 |
| 3,272,982 | 9/1966 | Stewart | 104/1 R X |
| 3,365,572 | 1/1968 | Strauss | 246/187 C |
| 3,521,565 | 7/1970 | Plasser et al. | 104/4 |
| 3,762,333 | 10/1973 | Theurer et al. | 104/12 |
| 3,823,673 | 7/1974 | Wesener | 104/299 |
| 3,828,681 | 8/1974 | Christensen et al. | 104/299 X |
| 3,921,830 | 11/1975 | Bright | 246/182 B X |
| 4,046,077 | 9/1977 | Theurer et al. | 104/2 |
| 4,085,913 | 4/1978 | Chang | 104/299 X |
| 4,135,631 | 1/1979 | Theurer et al. | 414/339 |

*Primary Examiner*—Randolph A. Reese
*Attorney, Agent, or Firm*—Kurt Kelman

[57] ABSTRACT

An apparatus for operating transport vehicles movable along a track carried by a train of railroad cars to and from a transfer station for loading the vehicles comprises a signalling arrangement including an emitter of perceptible stop-and go-signals for a respective transport vehicle. The signal emitter is positioned at the transfer station within the range of perception of the transport vehicle.

6 Claims, 2 Drawing Figures

Figure 1:
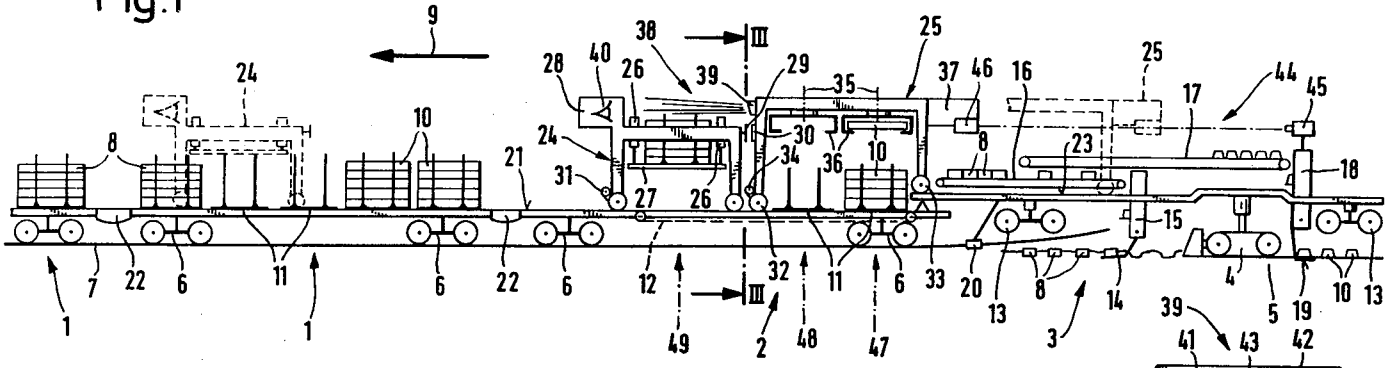

APPARATUS FOR OPERATING TRANSPORT VEHICLES MOVABLE ON A TRACK CARRIED BY A TRAIN OF RAILROAD CARS

The present invention relates to apparatus for operating transport vehicles for transporting ties and movable on a through track carried by a track renewal train.

Such transport vehicles running on a train of flat cars are used on track renewal trains for moving old and new ties from and to the track renewal zone between storage cars, which form part of the train, and the work car operating at the track renewal zone.

U.S. Pat. No. 3,521,565, dated Jul. 21, 1970, for example, discloses a track renewal train including a gantry crane running on a track carried by the flat cars of the train for moving new ties to the renewal site.

Our U.S. Pat. No. 4,046,077, dated Sept. 6, 1977, discloses a track renewal train with a work car coupled to the end of the train and supporting apparatus for picking up and transporting existing track sections positioned between a front on-track bogie supporting the work car on the existing track and a rear off-track bogie supporting the work car on a trackless section bridged by the work car. A mechanism for laying new ties is mounted on the work car behind the off-track bogie. An elongated conveyor for transporting the new ties to the tie laying mechanism is mounted on the work car above the apparatus for picking up and transporting existing track sections and this conveyor extends from the tie laying mechanism to a tie transfer station on a train car preceding work car. Two gantry cranes are designed to cooperate to transport the track sections to storage cars forming part of the train and these cranes also have mechanisms for engaging and carrying the new ties so that these cranes may run back along the train to remove the old track sections and on their way back transport new ties to the tie transfer station.

In work trains where two or more transport vehicles move along the track on the train simultaneously or according to a programmed cycle, the movements and operating cycles of the vehicles require careful coordination with respect to their relative movement and to the transfer station to avoid collisions and to assure the properly timed arrival at the transfer station. In modern and efficiently operating work trains of the indicated types, the transport vehicles must be moved at relatively high speeds and the resultant strain on the operating personnel in constantly observing and controlling the movements of the vehicles on the moving train is considerable.

It is the primary object of this invention to provide an apparatus for operating such transport vehicles in a simple, safe and efficient manner assuring improved coordination of the vehicle movements in the full cycle of operations. Such an apparatus will sensibly relieve the operating personnel from their control responsibilities.

The above and other objects are accomplished in an unexpectedly simple manner according to the invention with a signalling arrangement including an emitter of perceptible stop and go-signals for a respective one of the transport vehicles. The signal emitter is positioned at the transfer station for the goods carried by the vehicles to and from the transfer station, within the range of perception of the transport vehicle.

Such a signalling arrangement is quite inexpensive and may be readily installed on existing work trains to give an operator of the transport vehicle a clear and unmistakeable signal of the state of traffic at the transfer station. Thus, the operator need no longer rely on his own observation of the situation at the transfer station but receives an instantaneous signal indicating whether he must stop or may go. The type, number and characteristics of the signals may be varied according to requirements to provide to the operator all the information he needs for operation of the transport vehicle he controls. This avoids human errors and possible collisions resulting from misunderstood hand signals and, in addition, enables the operator to concentrate on the control and operation of this vehicle. In this manner, the signalling arrangement not only assures a trouble-free but also an accelerated transport of the goods to and from the transfer station, which greatly increases the efficiency of the entire operation of which the transport is a part.

Figure 2:
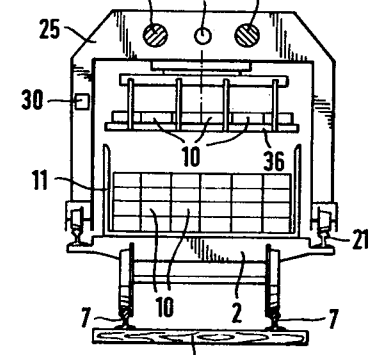

The above and other objects, advantages and features of the present invention will become more apparent from the following detailed description of certain now preferred embodiments thereof, taken in conjunction with the accompanying schematic drawing herein FIG. 1 is a partial side elevational view of a track renewal train equipped ith the signalling arrangement of this invention;

FIG. 2 is a front view of one of the transport vehicles on the track reneal train of FIG. 1, taken along line III—III.

Referring now to the drawing there is shown a track renewal train moving in an operating direction indicated by arrow 9 and including a series of freight cars 1, followed by transfer car 2 and work car 3 whose forward end is pivotally supported on the work car and whose rear end is supported by off-track bogie 4 on the ballast of a trackless section in which old ties 8 and old rails 7 of the existing track, on which the train moves, are removed. The work car has two selectively usable on-track bogies 13 and carries operating equipment including means 14, 15 for removing the old ties, elongated conveyor 16 for removing the old ties, th old ties being lifted to the conveyor by elevator 15 of the tie removing means, means 18, 19 for laying new ties 10, elongated conveyor 17 for moving the new ties to the tie laying means, conveyor 17 being superposed and overlapping conveyor 16, and elevator 18 of the tie laying means lowering the new ties from conveyor 17 to the ballast bed, and guide roller means 20 for raising and spreading the old rails in the work zone. The general track renewal train and the operating equipment on the work car arrangements are conventional and the specific arrangement of the work car is more fully described and illustrated in our concurrently filed patent application Ser. No. 37,101, now U.S. Pat. No. 4,236,452, entitled "Mobile Apparatus for Continuously Renewing Track". The present invention is not concerned with these specific arrangements or the specific operating equpiment disclosed herein to illustrate the operation of the signalling arrangement for operating conventional transport vehicles for goods used on such known track renewal trains. In this embodiment, the goods are old ties 8 and new ties 10 which are stored in superposed layers on pallets 11.

Railroads cars 1 and 2 are flat cars which have undercarriages 6 running on the existing track. The ties are stored on pallets 11 on cars 1 and car 2 comprises endless conveyor 12 flush with the flat bed of the car for moving respective pallets 11 along the car in a manner and for a purpose to be described hereinafter.

All the above structures and their operation are conventional and, therefore, not described in detail, as is through track 21 carried by the train of railroad cars and consisting of two rails mounted along the sides of the cars and running over ramps 22 interconnecting the cars where they are coupled together. Work car 3 carries track 23 in longitudinal alignment with track 21 but at a higher level than track 21, track 23 extending from the forward end of work car 3 within the range of elevator 15 which sequentially delivers old ties 8 to conveyor 16. Two gantry cranes 24 and 25 constitute transport vehicles for the old and new ties, the vehicles being movable on track 21 to move the ties between storage cars 1 and work car 3. Forward vehicle 24 has wheels running on rack 21 while rear vehicle 25 has front wheels running on track 21 while rear vehicle 25 has front wheels 32 running on track 21 while its rear wheels 33 run on track 23. This second or rear vehicle constitutes a movable transfer station for the ties in a manner to be described hereinafter.

First or forward vehicle 24 carries a hoist for pallets 11, which comprises vertical adjustment drives 26 and pallet grippimg mechanism 27 operable to hold, lit and lower a pallet loaded with ties. It also carries elevated operator's cab 28 at a front end and abutment element 29 at a rear end thereof. Vehicle 24 is self-propelled, drive 31 being operatively connected to its front wheels for moving the vehicle along track 21. Second vehicle 25 is also self-propelled, drive 34 being operatively connected to its front wheels 32 for moving the vehicle along tracks 21 and 23. The second vehicle also carries an abutment element 30, abutment elements 29 and 30 being arranged to contact each other when vehicles 24 and 25 move into abutting relationship. A control circuit connects drive 31 to the abutment elements and is closed by their contact with each other for operation of the drive. Vehicle 25 carries a pair of hoists 36 each capable of gripping, lifting and lowering a respective layer of new ties 10 from its supporting pallet and being rotatable about vertical axis 35 for turning the layer of ties 90°. It also carries elevated operator's cab 37 at the rear end thereof. The structure and operation of such gantry cranes with hoists for transporting ties on track renewal trains are conventional and will, therefore, not be described in detail.

According to the present invention, first and second transport vehicles 24 and 25 are operated in accordance with a predetermined operating program with the aid of a signalling arrangement shown in two embodiments in the track renewal train of FIGS. 1 and 3. Each signalling arrangement includes an emitter of perceptible stop-and go-signals for a respective one of the vehicles. Signalling arrangement 38 associated with the vehicles includes emitter 39 of optical signals within the visible range of operator 40 located in cab 28 on gantry crane 24. Signal emitter 39 is mounted on the front face of gantry crane 25 and, as shown in FIG. 3, includes red signal lamp 41 as a stop signal, green signal lamp 42 as a go signal and another signal lamp 43 therebetweeen, which may emit a white signal, for indicating the desired operating direction of vehicle 25. Signal lamp 43 may be responsive, for example, to the operation of drive 34 and light up to signal forward movement of vehicle 25 in the direction of arrow 9. Optical signals are particularly simple and inexpensive as signals giving operator 40 the most important types of information indicating the state of operation for his guidance. Signal lamps will be effective in darkness and under other operating conditions of low visibility. Red and green are, of course, the internationally accepted signals for stop and go.

The arrangement of the signal emitter on second vehicle 25 is particularly useful in the hereinabove described known type of track renewal train wherein the ties are transferred from one of the gantry cranes to an adjacent gantry crane during their transport between the track renewal zone and the storage cars.

Second signalling arrangement 44 includes signal emitter 45 arranged on work car 3 at a transfer station where new ties 10 are delivered from conveyor 17 to elevator 18 of the tie laying means. The emitter 45 emits beams of radiation, such as infrared, laser or radio beams, and vehicle 25 comprises receiver 46 responsive to the signal beam coming from emitter 45, receiver 46 being arranged within the range of perception of an operator in cab 37. Such a wireless transmission of signals has the advantage that the signals are immediately available in the operator's cab without necessitating visual observation of the signal emitter over a distance. In addition, such signals may be used to operate not only visible signals in the cab but also acoustical signals, for instance bells. Furthermore, the wireless transmission of signals is completely independent of weather conditions and visibility.

As the following description of the most essential portions of a typical operating program for gantry cranes 24 and 25 will show, signalling arrangements 38 and 44 facilitate the trouble-free execution of this program by giving the operators the decisive information needed:

Gantry cranes 24 and 25 are shown in full lines in FIG. 1 in an operating state shortly before the track renewal operation on work car 3 starts. The train moves in the direction of arrow 9 and, during this movement, a few old ties 8 have been sequentially removed at 14, raised by elevator 15 and delivered to conveyor 16 which also moves in the direction of arrow 9 to bring the sequentially arranged ties to the forward end of work car 3. Ties 8 are supported on conveyor 16 abuttingly and extend transversely of the conveyor in the same position in which they have been picked up from the ballast bed. Meanwhile, conveyor 17 has delivered a similar array of new ties 10 to elevator 18 which lowered them to the ballast bed where they are laid at 19.

Emitter 45 at the transfer station of new ties from conveyor 17 to elevator 18 emits a signal indicating an imminent need for a fresh supply of new ties 10 and an accumulation of old ties 8 requiring imminent removal. For this purpose, conveyors 16 and 17 may be equipped with suitable tie sensors or counters producing suitable control signals to which emitter 45 responds to generate the indicating signal. The signal will be generated when the sensors or counters on the conveyors indicate that conveyor 16 is almost loaded with old ties 8 and conveyor 17 is correspondingly almost empty. Upon receipt of the signal at receiver 46, where it may be transformed into an optical and/or acoustical signal, the operator in cab 37 of gantry crane 25 will be immediately alerted to the required operation of the crane. This includes the following sequential steps:

Previously and in a manner more fully described hereinbelow, a pallet supporting a plurality of superposed layers of new ties 10 all extending in a direction parallel to rails 7 has been positioned below rear hoist 36 of gantry crane 25 and the topmost layer of the new ties has be lifted off the pallet by the rear hoist. Upon receipt of the alert signal, the operator in cab 37 will now turn rear hoist 36 90° about vertical axis 35 so that ties 10 extend at right angles to rails 7, in which position they are to be laid on the ballast bed. With the new ties repositioned, drive 34 is acutated to move gantry crane 25 into its rear end position shown in broken lines, wheels 32 and 33 of the gantry crane running on tracks 21 and 23, respectively. The hoist carring new ties 10 is then lowered to deposit the layer of new ties on the portion of conveyot 17 overlapping lower conveyor 16. In this end position of gantry crane 25, forward hoist 36 of the crane is in registry with the layer of old ties 8 on the forwardy extending portion of conveyor 16. While rear hoist 36 deposits new ties 10 on conveyor 17, front hoist 36 grips and picks up old ties 8 from conveyor 16. The deposit of the fresh supply of new ties and removal of the accumulation of old ties will cause the respective sensors or counters to generate a control signal extinguishing the signal generated by emitter 45. If desired, this alert signal may be replaced by a go signal for gantry crane 25. On disappearance of the alert signal from emitter 45 and the possible generation of a go signal, the operator will reverse drive 34 to move gantry crane 25 back into its starting position shown in full lines. Signal lamp 43 is actuated in response to this forward drive of crane 25 and will light up to indicate this moving direction of the crane.

Twin hoists 36 are now turned back 90° so that old ties 8 carried by front hoist 36 are positioned parallel to rails 7 and this hoist is lowered to deposit the old ties in this position on empty pallet 11 placed below this hoist while the other hoist is simultaneously operated to lift another layer of new ties 10 from the adjacent pallet. The apparatus is now in position to respond to the next sequence of the above operating steps in response to the next alert signal generated by emmiter 45.

During these tie transfer operations effectuated by transport port vehicle (gantry crane) 25, red (stop) signal light 41 remains lit to alert operator 40 of transport vehicle (gantry crane) 24 to a state of operation wherein he must hold the vehicle against movement along track 21 from its front position 49 to a rear position. Previously, first gantry cane 24 had been moved along track 21 to one of storage cars 1 to pick up a pallet loaded with new ties 10 and this loaded pallet is held in readiness on the crane in the position shown in FIG. 1.

When rear hoist 36 has picked up the lowermost, last layer of new ties deposited on a pallet underneath the hoist and has turned this layer of ties 90°, red and white lights 41 and 43 will be extinguished and green light 42 will light up to alert operator 40 to a "go" state of operations assuming that emitter 45 continues to generate a go signal for gantry crane 25. When the operator perceives the go signal at emitter 39, he will actuate drive 31 to move gantry crane 24 so that it immediately follows the rear movement of gantry crane 25. During this tandem movement of the gantry cranes, abutment elements 29 and 30 prevent the two vehicles from coming too close to each other. For this purpose, a control circuit connects drive 31 of gantry crane 24 to the abutment elements and this control circuit is closed by contact of the abutment elements with each other for operation of the drive. On contact of the abutment elements, the drive speed is reduced or the drive is stopped altogether so that the desired distance between the two gantry cranes is maintained. In this manner, the gantry cranes may be moved in tandem at a desired, usually very close distance from each other, and their movements may be synchronized.

During or shortly before the tandem backward movement of gantry cranes 24 and 25, endless conveyor 12 on transfer car 2 is actuated to drive the conveyor forwardly, thus moving pallet 11 loaded with old ties 8 during the preceding operations from center position 48 to forward position 49 and pallet 49 and pallet 11, originally loaded with new ties but now empty, from rear position 47 to center position 48 on car 2. At this point, first gantry crane 24 has reached rear position 47, vertical adjustment drive 26 is operated and the pallet loaded with layers of new ties 10 is lowered onto the flat bed of car 2, conveyor 12 meanwhile having been stopped. Drive 31 is now reversed to return vehicle 24 to position 49 where the pallet loaded with old ties 8 is hoisted and moved forward along track 21 to one of storage cars 1 wherein the loaded pallet is stored. On its return movement along track 21 to position 49, gantry crane 24 picks up another pallet loaded with new ties 10 to be ready for a repetition of the preceding operating cycle.

It is desirable in the illustrated embodiment for trailing transport vehicle 24 to follow the movement of leading transport vehicle 25 immediately after the last layer of new ties has been loaded on the loading vehicle. With illustrated signalling arrangement 38, operator 40 of the trailing vehicle can keep drive 31 in readiness so that, at the moment of the signal change from "stop" to "go", the trailing vehicle moves simultaeously with the leading vehicle. The same holds for the practically simultaneously braking of the two vehicles. This not only reduces the drive time but increases the operating safety since it avoids possible collisions, which effect is further increased by the addition of signal 43 indicating the drive direction. Signal emitter 39 may, if desired, generate additional alert signals, for instance to signal the urgent need for new ties and for promptly removing old ties. It is also possible to mount signal emitters on both vehicles so as to allow intercommunication between the operators of the vehicles. Advantageously, drive 34 for moving second vehicle 25 controls signal emitter 39 so that the emitter is responsive to the drive and automatically emits the stop- and go-signals in response to a corresponding state of the drive, thus eliminating possible source of signaling errors and assure a fully automatic operation of the alert signal arrangement.

Various modifications and changes may occur to those skilled in the art without departing from the spirit and scope of the present invention, as defined in the appended claims, particularly in connection with the specifc structure of the signalling arrangement, the nature of the alert signals, and the like.

What is claimed is:

1. A track renewal train comprising a succession of storage cars and a work car, a through track carried by the cars, a fit transport vehicle movable on the through track towards and away from the work car for moving new ties towards the work car and old ties away from the work car, a drive for moving the first transport vehicle, a second transport vehicle adjacent the first vehicle and movable on the through track between the first vehicle and the work car for transferring the new ties from the first vehicle and the old ties to the first vehicle and for transporting the ties between the work car and the first vehicle, respective abutment elements on the vehicles arranged to contact each other when the vehicles move into abutting relationship, a control circuit connecting the drive to the abutment elements and being closed by their contact with each other for operation of the drive, and a signalling arrangement including emitter and receiver means of perceptible stop- and go-signals positioned to emit and receive the signals within the range of perception of at least one of the transport vehicles for controlling the operation thereof.

2. The track renewal train of claim 1, further comprising a drive for moving the second transport vehicle, the emitter means of the signalling arrangement emits signals within the range of perception of the first vehicle and being responsive to the second transport vehicle drive for automatically emitting the stop- and go-signals in response to a corresponding state of the drive.

3. The track renewal train of claim 1, comprising two of the signalling arrangements positioned respectively to emit and receive the signals within the range of perception of both vehicles.

4. The track renewal train of claim 3, wherein the signals within the range of perception of the first vehicle are optical signals.

5. The track renewal train of claim 3, wherein the emitting means of the signalling arrangement emitting signals within the range of perception of the second vehicle emits beams of radiation and the receiver means thereof is mounted on the second vehicle.

6. The track renewal train of claim 5, further comprising a drive for moving the second transport vehicle, the drive being responsive to the receiver means mounted thereon for automatically braking the drive and placing the drive into a state of readiness.

* * * * *